US005957756A

United States Patent [19]

Figge et al.

[11] Patent Number: 5,957,756

[45] Date of Patent: Sep. 28, 1999

[54] PROCESS AND DEVICE FOR REGRINDING ROLLS INSTALLED IN HOT-STRIP ROLL STANDS

[75] Inventors: Dieter Figge, Essen; Peter Jollet, Düsseldorf, both of Germany

[73] Assignee: Mannesmann Aktiengesellschaft, Dusseldorf, Germany

[21] Appl. No.: 08/910,288

[22] Filed: Aug. 13, 1997

[30] Foreign Application Priority Data

Aug. 16, 1996 [DE] Germany ..... 196 33 855

[51] Int. Cl.[6] ..... B24B 1/00

[52] U.S. Cl. ..... 451/49; 451/142

[58] Field of Search ..... 451/24, 11, 10, 451/142, 49

[56] References Cited

U.S. PATENT DOCUMENTS

| | | | |
|---|---|---|---|
| 3,353,302 | 11/1967 | Lowy | 51/49 |
| 4,575,972 | 3/1986 | Ohki et al. | 51/251 |
| 4,619,080 | 10/1986 | Okamoto et al. | 51/251 |
| 4,716,687 | 1/1988 | Tsukamoto et al. | 51/131.1 |
| 4,827,751 | 5/1989 | Holthoff | 72/236 |

FOREIGN PATENT DOCUMENTS 44 09 060 9/1995 Germany .

*Primary Examiner*—David A. Scherbel
*Assistant Examiner*—Dung Van Nguyen
*Attorney, Agent, or Firm*—Cohen, Pontani, Lieberman & Pavane

[57] ABSTRACT

A process for regrinding the rolls installed in hot-strip roll stands using rotating pot-shaped grinding tools which are movable in an oscillating manner parallel to the roll axis. The grinding tool is fastened to the end of a grinding shaft which is driven in rotation so as to be axially displaceable transversely to the roll, guided coaxially in a grinding sleeve and connected at its opposite end with a displacing drive supported directly at the housing. The contact pressing force of the grinding tools at the roll is applied by compressed air which is supplied to the displacing drives. The air pressure, which is preset corresponding to the desired contact pressing force, is changed within a narrow range until the torques of all grinding tools or of one of the grinding tools measured at the drive motors for the grinding tools which are driven in rotation are identical and constant.

6 Claims, 2 Drawing Sheets

PROCESS AND DEVICE FOR REGRINDING ROLLS INSTALLED IN HOT-STRIP ROLL STANDS

BACKGROUND OF THE INVENTION

1. Field of the Invention

The invention relates to a working process and to a device for carrying out a working process for regrinding rolls installed in hot-strip roll stands by means of pot-shaped grinding tools which are driven in rotation and are movable in an oscillating manner parallel to the roll axis. The grinding tool is fastened to the end of a grinding shaft which is driven in rotation so as to be axially displaceable transversely to the roll, guided coaxially in a grinding sleeve and connected at its opposite end with a displacing drive supported directly at the grinding sleeve.

2. Description of the Prior Art

A device of the generic type is provided for regrinding rolls which are installed in hot-strip roll stands, especially the work rolls in four-high roll stands. The contour of the roll can be reground while in the installed state in the roll stand by means of rotating pot-shaped grinding tools which are distributed along the length of the barrel or body of the roll to be ground and which are movable in an oscillating manner parallel to the roll axis together with the tool carrier receiving them and are independently adjustable transversely to the roll axis in a pressure-regulated manner. Every grinding tool is separately driven in rotation in such a way that it can be regulated with respect to speed.

In order to adjust the grinding tools toward the roll, the prior known solution suggests displacing the tailstock sleeve with the tools in the longitudinal direction by means of piston-cylinder units and thus controlling the path of the tool. The piston-cylinder units are regulated with respect to pressure and path, so that every grinding position and every grinding pressure can be controlled. The rotary drives for the grinding tools, preferably electric motors, are arranged at the end of the tailstock sleeve opposite to the grinding tool.

In the prior art, there is no mention of a method of applying the contact pressing force. The magnitude of the contact pressing force determines the grinding rate or removal rate of the grinding process. In particular, when grinding a roll with a plurality of grinding disks the contact pressing force of every disk must be identical so that no differences in diameter occur at the roll at the transition points between the paths of the individual grinding heads. Differences in diameter at the roll signify a jump in the surface which results in non-planar strips and accordingly leads to waste. Thus, the method of applying and transmitting the contact pressing force is very important for high-quality grinding.

SUMMARY OF THE INVENTION

Based on the preceding, the object of the present invention is to provide a working process and a device for carrying out this process by means of which the contact pressing force of the grinding tools against the roll can be regulated in an exact manner in order to generate a high-quality surface of the roll by pressure-regulated and path-regulated grinding.

Pursuant to this object, and others which will become apparent hereafter, one aspect of the present invention resides in a process in which the provided contact pressing force of the grinding tools at the roll is applied by means of compressed air which is supplied to the displacing drives.

The pressure of the air, which is preset corresponding to the desired contact pressing force, is changed within a narrow range until the torques of all grinding tools, measured at the drive motors for the grinding tools which are driven in rotation, are identical and constant.

The inventive working process enables a uniform removal rate when two or more grinding tools are used. By increasing or reducing the contact pressing force of the grinding tools against the roll until the torque at the grinding motor equals a constant quantity, it is ensured that none of the tools can grind a "step" into the surface of the roll due to increased contact pressing pressure and an accordingly increased removal rate.

The removal rate of the grinding tool can be determined by way of the torque of the drive. Therefore, in one embodiment, the torque of the grinding tool can be measured via the current consumption of its drive motor. When both motor currents of the drive motors are maintained constant, it can be assumed that the removal rate of the two grinding tools is likewise constant. With this method, a uniform grinding can be ensured and steps can be reliably avoided in the roll surfaces to be machined.

A device for carrying out the working process described above has a displacing drive constructed as an air cylinder with a ball-loaded rod. The air cylinder is guided in a force-regulated, low-friction manner. The grinding shaft is guided so as to be axially displaceable in the grinding sleeve in a low-friction manner, also via ball guides. The weight forces of the grinding head are counterbalanced by at least one additional air cylinder which is guided in a low-friction manner so as to act between the grinding sleeve and a housing part receiving the grinding sleeve. The air cylinders are preferably constructed as roll-diaphragm cylinders. However, if the strokes are too large and cannot be carried out with roll-diaphragm cylinders due to the type of construction, double acting air cylinders which are outfitted with easy-running seals and rolling guides can be used.

It is not possible to apply axial forces for the grinding tools where needed. At best, this would be directly at the grinding pot by means of an air cylinder sitting at the latter. For this purpose, however, the air medium would have to be guided into the rotating grinding shaft without pressure losses via a rotary leadthrough. At grinding shaft speeds of 3000 RPM, such rotary leadthroughs are not tight in continuous operation.

For this reason, the air cylinder is placed in a stationary manner at the rear end of the grinding tool and guides the contact pressing force to the rotating grinding shaft via two axial pressure bearings. According to the invention, air cylinders with rolling guide means, which are mounted so as to be axially displaceable with low friction, are used as air cylinders. Weight forces occurring due to the grinding head inclination are compensated by a second air cylinder, which likewise has rolling guide means, so that differences in friction and differences in weight can be compensated for to a great extent by means of the invention. Roll-diaphragm air cylinders are preferably used. The present invention represents a substantial improvement over the prior art in which considerable friction forces compulsorily occur between the grinding shaft and the grinding sleeve during the displacement of the grinding shaft. Additional friction forces occur at the air cylinders by means of the piston seals and rod seals. These friction forces act in different directions during the displacement of the grinding shaft, since the grinding tool is generally installed at an inclination in the roll stand.

All of these problems are avoided by the present invention.

In a construction of the invention, a path measurement system for the axial displacement path of the grinding tool is provided parallel to the effective directions of the air cylinder. It is accordingly possible to purposely control the roll surface being machined by the grinding tool, e.g., to produce spherical roll contours.

As a result of the invention, the force differences to be measured at the grinding tool in different movement directions are very small. With identical forces at the air cylinders, the volume of material removed is also virtually identical, i.e., the left and right grinding tool or tools will grind a surface virtually without steps at the roll. Any existing differences can be compensated for by the control, for example, in that the contact pressing force is reduced in the middle region of the roll where the grinding paths of the grinding tools overlap.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 2:
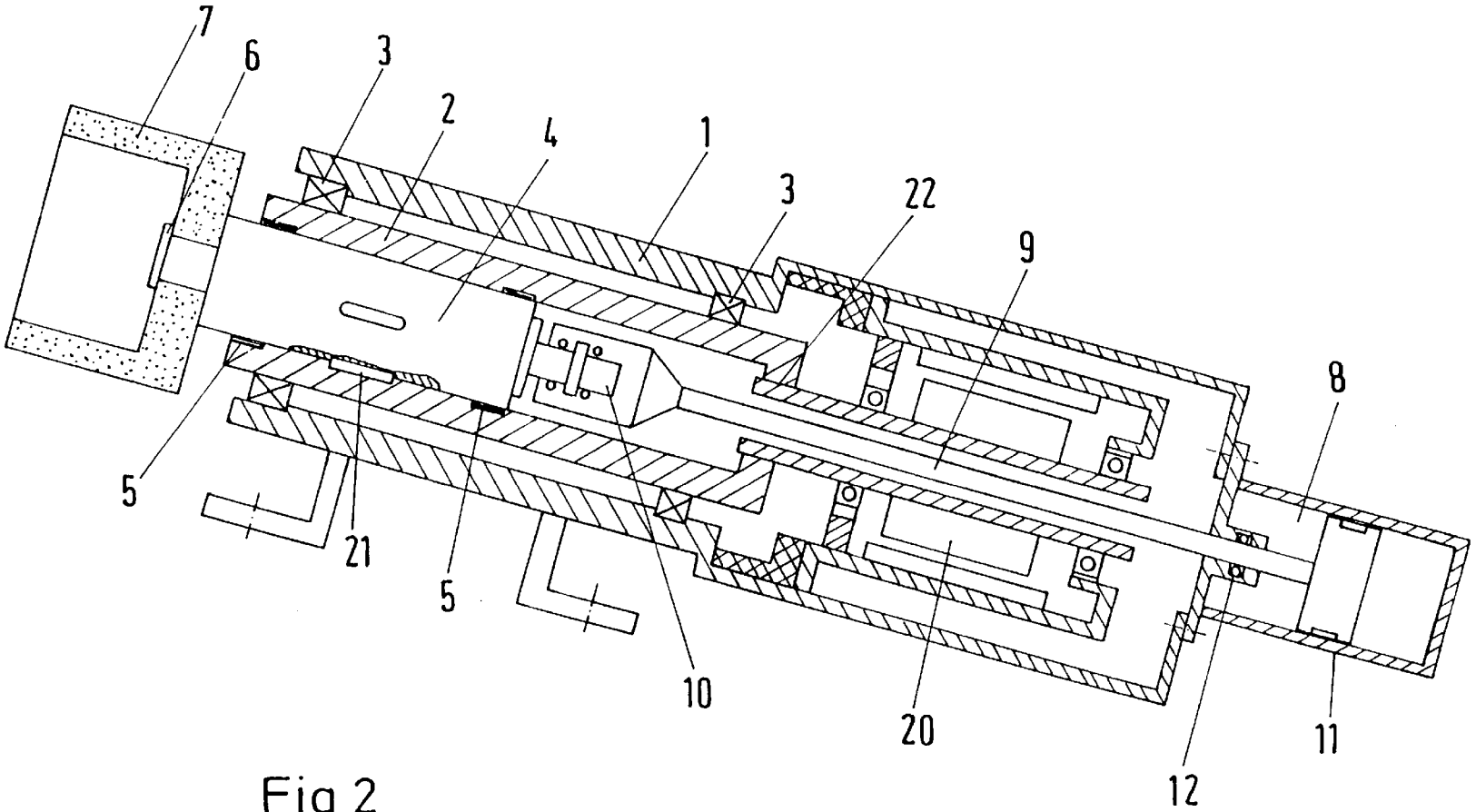
FIG. 2 shows a conventional device according to the prior art.

The set of problems upon which the invention is based will first be explained with reference to conventional grinding devices. In a roughly schematic view in FIG. 2, the tubular grinding sleeve 2 is rotatably mounted 3 in a housing 1 and is guided so as to be coaxially displaceable. A grinding shaft 4 is mounted in sliding guides 5 in the grinding sleeve 2 so as to be axially displaceable. The pot-shaped grinding tool 7 is fastened to the front end of the guiding shaft 4 by a connector 6. An air cylinder 8 is provided for displacing the pot-shaped grinding tool 7. The air cylinder 8 sits on the end of the grinding sleeve 2 remote of the pot-shaped grinding tool 7 and allows a displacement of the rotary driven grinding shaft 4 via a connection rod 9 and an axial pressure bearing 10 which enables rotation. Feather keys or adjusting springs 21 are provided between the grinding shaft 4 and the grinding sleeve 2 for rotational driving. The air cylinder 8 can be acted upon at both ends so as to enable axial displacement of the grinding shaft 4 in both directions. The rotational driving is effected via the integrated electric motor 20 whose motor shaft is coupled at 22 with the grinding sleeve 2.

The disadvantage of this construction is that extensive frictional resistance takes effect in different directions during the displacement of the grinding shaft 4. On one hand, friction occurs between the grinding shaft 4 and the grinding sleeve 2 in the sliding guides 5 and, on the other hand, the piston seals 11 and the seals 12 for the rod leadthrough cause frictional resistance. Since the grinding tool is installed at an inclination in the roll stand, the friction forces also act in different directions during the displacement of the grinding shaft. This is explained in the following with reference to a practical example. The following forces result during displacement toward the roll:

| | | |
|---|---|---|
| weight component | = | 21 kp |
| friction of grinding shaft in grinding sleeve | = | 12 kp |
| friction in conventional air cylinder | = | 25 kp |
| contact pressing force | = | 35 kp |
| total | = | 93 kp. |

The following forces result during displacement away from the roll:

| | | |
|---|---|---|
| weight component | = | 21 kp |
| friction of grinding shaft in grinding sleeve | = | −12 kp |
| friction in conventional air cylinder | = | −25 kp |
| contact pressing force | = | 35 kp |
| total | = | 19 kp. |

It will be seen from this example that the total force, that is, the force applied by the air cylinder, varies considerably depending upon the movement direction of the grinding tool. However, when traveling over a roll with a spherical contour, the grinding shaft must be moved in different directions. When working with a constant air cylinder force, the contact pressing pressure of the disk can vary widely depending upon the movement direction. Accordingly, the volume removed from the roll diverges from the desired results and leads to a deterioration in quality at the surface of the roll and at the contour.

Figure 1:
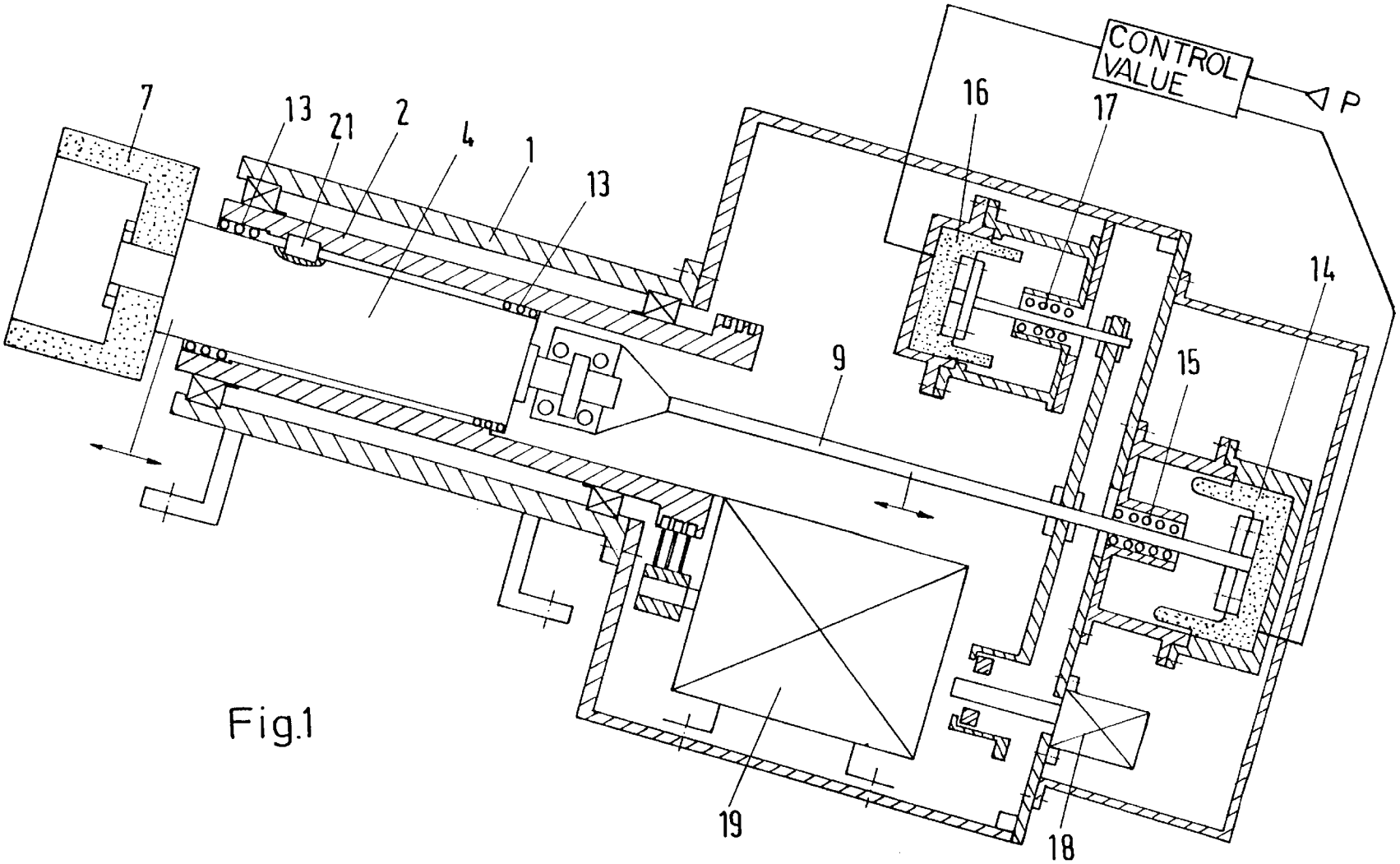
FIG. 1 shows a device according to the invention in cross section for small strokes.

A solution according to the present invention for small strokes is shown in FIG. 1. In the invention, the grinding shaft 4 is guided in the grinding sleeve 2 in a low-friction manner via a ball guide 13. The contact pressing force of the pot-shaped grinding tool 7 is applied by means of a roll-diaphragm air cylinder 14 whose ball-guided rod 9 is likewise guided with low friction in a roller guide 15. The weight forces resulting from the inclination of the grinding tool are also compensated by a second roll-diaphragm air cylinder 16 which is also guided with low friction by a roller guide 17. A path measurement system 18 is installed parallel to the two roll-diaphragm air cylinders 16, 14. The air cylinders being supplied with air from a pump P via a control valve.

In the solution according to the invention, there are only very small differences in force during displacement of the grinding shaft 4 in different directions. In a practical example, the following forces result during movement toward the roll:

| | | |
|---|---|---|
| weight component | = | 21.0 kp |
| friction of grinding shaft in grinding sleeve | = | 2.0 kp |
| friction of low-friction air cylinder | = | 2.5 kp |
| contact pressing force | = | 35.0 kp |
| total | = | 60.5 kp. |

With movement away from the roll, the following forces are active:

| | | |
|---|---|---|
| weight component | = | 21.0 kp |
| friction of grinding shaft in grinding sleeve | = | −2.0 kp |
| friction in frictionless air cylinder | = | −2.5 kp |
| contact pressing force | = | 35.0 kp |
| total | = | 51.5 kp. |

It will be seen that the differences in force as the movement direction changes are very small in the present invention, namely, only 9 kp in the embodiment example, whereas the measurement taken in the conventional solution is 74 kp. Also, at the same air cylinder force, the volume of material removed is virtually identical in the invention, i.e., the pot-shaped grinding heads 7 arranged on the two roll halves will grind a surface at the roll virtually without steps and with a precise shape. Any differences can be compensated for by the control valve in that the contact pressing pressure of the pot-shaped grinding tools 7 is reduced in the region machined jointly (overlapped) by both grinding tools.

Insofar as only the grinding shaft is displaced with a correspondingly large axial stroke in alternative embodiments, the known roll-diaphragm air cylinder cannot be used due to this construction type. In this case, long-stroke cylinders are used which can execute long strokes as double-action special cylinders. The cylinders likewise have ball guides for the rods and use easy-running seals for the piston and rod.

Optimal removal rates and high-quality surfaces are achieved with the process according to the invention and the regrinding device for hot-strip roll stands in that the contact pressing pressure of the pot-shaped grinding tools against the roll is increased or reduced until the torque of all drives measured at the electric driving motors 19 by way of the motor current is equal to a constant amount. When the motor currents of all electric drive motors 19 are kept constant, it can be assumed that the removal rate of all pot-shaped grinding heads is likewise constant. Thus, small steps can also be reliably prevented at the surface regions of the rolls to be machined by different grinding tools.

The invention is not limited by the embodiments described above which are presented as examples only but can be modified in various ways within the scope of protection defined by the appended patent claims.

We claim:

1. A process for regrinding a roll installed in a hot-strip roll stand with pot-shaped grinding tools which are driven in rotation by drive motors and are movable in an oscillating manner parallel to an axis of the roll, comprising the steps of:

fastening a first end of each of the grinding tools to a first end of a respective grinding shaft so as to be axially displaceable transversely to the roll, a second end of each of the grinding shafts being connected with a displacing drive supported directly at a housing;

coaxially guiding each of the grinding shafts in a grinding sleeve;

applying a contact pressing force of the grinding tools at the roll by means of compressed air which is supplied to the displacing drives; and changing pressure of the air, which is preset corresponding to a desired contact pressing force, within a narrow range until torques of at least one of the grinding tools measured at the drive motors for the grinding tools are identical and constant.

2. A process for regrinding a roll according to claim 1, and further comprising the step of measuring torque via current consumption of the electric drive motors.

3. A device for regrinding a roll installed in a hot-strip roll stand, comprising:

a housing;

a rotating pot-shaped grinding tool movable in an oscillating manner parallel to an axis of the roll;

a grinding shaft having a first end to which the grinding tool is fastened so as to be axially displaceable transversely to the roll, and a second end;

means for rotating the grinding shaft;

a grinding sleeve, the grinding shaft being coaxially arranged in the grinding sleeve;

displacing drive means supported directly at the housing and connected to the second end of the grinding shaft for axially displacing the grinding shaft in the grinding sleeve, the displacing drive including an air cylinder with a rod supported in the housing by a ball guide, the air cylinder being guided in a force-regulated, low-friction manner;

ball guides arranged between the grinding sleeve and the grinding shaft so that the grinding shaft is axially displaceable in a low-friction manner; and at least one additional air cylinder which is guided in a low friction manner and operatively arranged in the housing so as to counterbalance weight forces of the grinding tool.

4. A device for regrinding according to claim 3, wherein the air cylinders are constructed as roll-diaphragm cylinders.

5. A device for regrinding according to claim 4, wherein the grinding sleeve is arranged in the housing, the additional air cylinder being arranged so as to act between the grinding sleeve and the housing.

6. A device for regrinding according to claim 3, and further comprising a path measurement system arranged parallel to the effective direction of the air cylinders and operative for measuring the axial displacement path of the pot-shaped grinding tool.

* * * * *